US005507940A

United States Patent [19]

Ryan

[11] Patent Number: 5,507,940

[45] Date of Patent: Apr. 16, 1996

[54] HYDRODENITRIFICATION CATALYST AND PROCESS

[75] Inventor: Robert C. Ryan, Houston, Tex.

[73] Assignee: Shell Oil Company, Houston, Tex.

[21] Appl. No.: 341,254

[22] Filed: Nov. 17, 1994

Related U.S. Application Data

[63] Continuation of Ser. No. 84,681, Jun. 29, 1993, abandoned, which is a continuation-in-part of Ser. No. 752,297, Aug. 30, 1991, abandoned.

[51] Int. Cl.[6] ..... C10G 45/00; C10G 47/10; B01J 21/04; B01J 21/12

[52] U.S. Cl. ..... 208/254 H; 208/108; 502/158; 502/225; 502/259; 502/263

[58] Field of Search ..... 208/254 H, 108; 502/158, 255, 259, 263

[56] References Cited

U.S. PATENT DOCUMENTS

| | | | |
|---|---|---|---|
| Re. 30,668 | 7/1981 | Buonomo et al. | 502/263 |
| 2,394,796 | 2/1946 | Marisic | 208/120 |
| 2,428,741 | 10/1947 | Plank | 208/114 |
| 2,441,214 | 5/1948 | Thomas et al. | 502/158 |
| 2,493,896 | 1/1950 | Pardee et al. | 502/263 |
| 2,722,504 | 11/1955 | Fleck | 208/110 |
| 3,089,845 | 5/1963 | Mosely | 208/139 |
| 3,389,092 | 6/1968 | Sanford et al. | 502/158 |
| 3,487,011 | 12/1969 | Henke et al. | 502/220 |
| 3,598,759 | 8/1971 | Bertolacini | 502/230 |
| 3,993,594 | 11/1976 | Myers | 502/230 |
| 4,013,589 | 3/1977 | Buonomo et al. | 502/263 |
| 4,013,590 | 3/1977 | Buonomo et al. | 502/263 |
| 4,038,337 | 7/1977 | Manara et al. | 585/671 |
| 4,080,284 | 3/1978 | Mitchell | 208/111 |
| 4,392,988 | 7/1983 | Dobson et al. | 502/10 |
| 4,520,128 | 5/1985 | Morales et al. | 502/210 |
| 4,530,911 | 7/1985 | Ryan et al. | 502/74 |

FOREIGN PATENT DOCUMENTS

| | | |
|---|---|---|
| 586196A1 | 3/1994 | European Pat. Off. . |
| 2121430 | 12/1983 | United Kingdom . |

OTHER PUBLICATIONS

Ben–Chang Kang et al., "Effect of Catalyst Composition on the Hydrodesulphurization and Hydrodemetallization of Atmospheric Residual Oil," *Applied Catalysis,* 45 (1988) 221–236.

Brunauer et al., "Adsorption of Gases in Multimolecular Layers," *Am Chem. Soc.,* 60 (Feb. 1938) 309–319.

*Primary Examiner*—E. Rollins Cross
*Assistant Examiner*—Walter D. Griffin

[57] ABSTRACT

The instant invention relates to a method for preparing a hydrotreating catalyst having improved hydrodenitrification activity by impregnating an alumina supported Group VIB/Group VIII hydrogenating catalyst with a liquid form of a silicon compound having the general formula

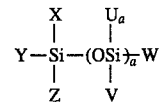

wherein U, V, W, X, Y, and Z can individually be —R, —OR, —Cl, —Br, —$SiH_3$, —COOR, —$SiH_nCl_m$, R being either hydrogen, or an alkyl, cycloalkyl, aromatic, alkyl aromatic, alkylcycloalkyl radical having from 1 to 30 carbon atoms, "n" and "m" being whole numbers in the range of from 1 to 3 and "a" being a whole number in the range of from 0 to 80, in an amount sufficient to deposit from about 2 to about 8 percent by weight of the total catalyst of Si, and subsequently calcining said impregnated catalyst at a temperature ranging from about 300° C. to about 600° C. in an oxidizing atmosphere.

22 Claims, No Drawings

HYDRODENITRIFICATION CATALYST AND PROCESS

This is a continuation of application Ser. No. 08/084,681, filed Jun. 29, 1993, now abandoned, which is a continuation-in-part of application Ser. No. 07/752,297, filed Aug. 30, 1991, now abandoned.

FIELD OF THE INVENTION

This invention relates to a method for improving the hydrodenitrification activity of a hydrofining catalyst, the catalysts resulting therefrom and their use in hydrotreating and first stage hydrocracking processes.

BACKGROUND OF THE INVENTION

Nitrogen-containing compounds in petroleum fractions can adversely affect end products. For example, nitrogen compounds can adversely affect the storage stability and octane value of naphthas and may extent, since it lowers the potential for $NO_X$ formation during subsequent poison downstream catalysts. Nitrogen removal improves air quality to some fuel combustion. Crude and other heavy petroleum fractions are typically subjected to hydrodenitrification in a hydrotreater to significantly reduce nitrogen compounds prior to being subjected to further processing by first and second stage hydrocracking. The first stage hydrocracker can also be used to further reduce nitrogen compounds in a feedstock prior to passing it to a second stage hydrocracker. Second stage hydrocracking catalysts can be adversely affected by high levels of nitrogen compounds in their feedstock.

First stage hydrocrackers need both good hydrodenitrification activity and cracking activity. Hydrocracking catalysts frequently comprise metals supported on amorphous silica-alumina supports which provide an acid cracking function. These silica-alumina materials are seriously poisoned by organic nitrogen species. A catalyst with good hydrodenitrification activity and which was provided with an enhanced cracking function that was not poisoned by organo nitrogen compounds could be used not only in hydrotreaters, but also in first stage hydrocrackers.

Applicant has developed a method for improving the hydrodenitrification activity and cracking activity of a hydrotreating/first stage hydrocracking catalyst. A more active catalyst can be operated at a lower temperature to obtain the same degree of nitrogen conversion as a less active catalyst. A lower operating temperature will prolong catalyst life and decrease operating expenses.

The prior art discloses several examples of modifications to catalysts using silicon compounds as modifying agents. U.S. Pat. No. 4,038,337, issued Jul. 26, 1977, discloses the treatment of alumina with silicon compounds to provide a catalysts which are more active and selective for olefin isomerization. U.S. Pat. Nos. 4,013,589 and 4,013,590 and Reissue number 30,668 all disclose methods for improving the thermal and mechanical properties of alumina by treating it with silicon compounds. U.S. Pat. No. 3,089,845 discloses that the properties of naphtha catalysts are improved by treating with a silicon compound such as tetraethyl orthosilicate. U.K. patent number 2,121,430 discloses also the treatment of isomerization catalysts by the treatment with silicon compounds such as ethyl orthosilicate.

SUMMARY OF THE INVENTION

The instant invention relates to a method for preparing a hydrotreating catalyst which comprises impregnating an alumina supported Group VIB/Group VIII hydrogenating catalyst with a liquid form of a silicon compound having the general formula

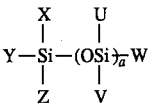

wherein U, V, W, X, Y, and Z can individually be —R, —OR, —Cl, —Br, $—SiH_3$, —COOR, $—SiH_nCl_m$, R being either hydrogen, or an alkyl, cycloalkyl, aromatic, alkyl aromatic, alkylcycloalkyl radical having from 1 to 30 carbon atoms, "n" and "m" being whole numbers in the range of from 1 to 3 and "a" being whole number in the range of from 0 to 80 in an amount sufficient to deposit from about 2 to about 8 percent by weight of the total catalyst of Si, and subsequently calcining said impregnated catalyst at a temperature ranging from about 300° C. to about 600° C. in an oxidizing atmosphere.

The instant catalysts have an enhanced hydrodenitrification activity. The also have an enhanced hydrocracking activity, which make them very suitable for first stage hydrocracking use in processing heavy feeds.

DESCRIPTION OF THE PREFERRED EMBODIMENTS

The catalysts that are to be treated with the silicon-containing organo-compounds according to the method of the instant invention comprise Group VIB and/or Group VIII metals supported on an alumina support. Preferably, they comprise a Group VIB hydrogenating metal component selected from nickel, cobalt and mixtures thereof and a Group VIII non-noble metal component selected from molybdenum, tungsten and mixtures supported on alumina. Preferably the catalysts comprise nickel and molybdenum supported on alumina. The catalysts are optionally promoted with phosphorous.

The metal-containing catalysts that are to be treated with silicon are catalysts that are known in the hydrocarbon hydroprocessing art. These catalysts are made in a conventional fashion as described in the prior art. For example, porous alumina pellets can be impregnated with solution(s) containing nickel and molybdenum and phosphorous compounds, the pellets subsequently dried and calcined at elevated temperatures. Alternately, one or more of the components can be incorporated into an alumina powder by mulling, the mulled powder formed into pellets and calcined at elevated temperature. Combinations of impregnation and mulling can be utilized. Other suitable methods can be found in the prior art. Non-limiting examples of catalyst preparative techniques can be found in U.S. Pat. No. 4,530,911, issued Jul. 23, 1985, and U.S. Pat. No. 4,520,128, issued May 28, 1985, both incorporated by reference herein. The catalysts are typically formed into various sizes and shapes. They may be suitably shaped into particles, chunks, pieces, pellets, rings, spheres, wagon wheels, and polylobes, such as bilobes, trilobes and tetralobes.

The metals-containing catalysts are impregnated with a liquid form of a silicon compound having the general formula

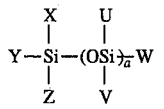

wherein U, V, W, X, Y, and Z can individually be —R, —OR, —Cl, —Br, —$SiH_3$, —COOR, —$SiH_nCl_m$, R being either hydrogen, or an alkyl, cycloalkyl, aromatic, alkyl aromatic, alkylcycloalkyl radical having from 1 to 30 carbon atoms, "n" and "m" being whole numbers in the range of from 1 to 3 and "a" being a whole number in the range of from 0 to 80, preferably in the range of from 5 to 60, in an amount sufficient to deposit from about 2 to about 8 percent, preferably from about 3 to about 6 percent by weight of the total catalyst of Si, and subsequently calcining said impregnated catalyst at a temperature ranging from about 300° C. to about 600° C. in an oxidizing atmosphere. In a particularly preferred embodiment, the metals-containing catalysts are impregnated with a liquid form of a silicon compound having the general formula

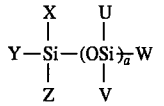

wherein U, V, W, X, Y, and Z can individually be —R or —OR, R being either hydrogen, or an alkyl, cycloalkyl, alkylcycloalkyl radical having from 1 to 30 carbon atoms and "a" being a whole number in the range of from 5 to 60, in an amount sufficient to deposit from about 3 to about 6 percent by weight of the total catalyst of Si, and subsequently calcining said impregnated catalyst at a temperature ranging from about 300° C. to about 600° C. in an oxidizing atmosphere.

The silicon-containing compounds are used in the liquid form to impregnate the catalysts. The silicon compounds may be used neat when they are in liquid form and their viscosity is such that they can readily be impregnated. Viscosities of less than about 100 centiStokes (cSt), measured at 40° C. are suitable, and viscosities of less than about 75 cSt are preferred. The viscosity of the silicon compound is directly related to the value of "a" in the above formula. Listed below are the viscosities for silicon compounds of the above formula in which U, V, W, X, Y, and Z are individually methyl and the corresponding value for "a" is as noted:

| a | Viscosity (cSt) |
|---|---|
| 0 | 0.65 |
| 1 | 1.0 |
| 2 | 1.5 |
| 3 | 2.0 |
| 5 | 3.0 |
| 8 | 5.0 |
| 11 | 7.0 |
| 15 | 10.0 |
| 25 | 20.0 |
| 49 | 50.0 |
| 79 | 100.0 |

In order to facilitate impregnation, the silicon compounds may be dissolved in suitable organic solvents, such as lower alkanes, alcohols, ketones, aromatics and the like. Also, aqueous emulsions of the organo silicon compounds can be used. The silicone oils are particularly useful, either neat or diluted with an appropriate organic solvent or in aqueous emulsion form. These silicone oils are readily available commercially from various manufacturers, such Dow Corning, Aldrich Chemical Co. (e.g., Aldrich 14,615-3; Aldrich 17,563-3), Petrarch Systems (e.g., Silicone Antifoam aqueous emulsion with 11.84 Si; Petrarch PS039.5) and Union Carbide (e.g., L45 (350)). Preferred terminal groups for the silicone oils are trimethylsilyl groups. Silicone oils with terminal hydroxy groups impregnate with difficulty, probably because of an interaction of the hydroxy group with the alumina support.

In general terms the metals-containing catalysts are impregnated with a liquid organo silicon compound and subsequently calcined in an oxidizing atmosphere in order to decompose the organo silicon compound to a silicon oxide. The oxidizing atmosphere is one that contains oxygen, and preferably is air. The air may be mixed with nitrogen during the initial stages of the calcination in order to prevent overheating of the catalyst as the silicone material oxidized. To obtain the benefits of the invention it is important that the silicon impregnation be carried out after the metals have been incorporated onto the carrier, rather than before. Thus, the silicon impregnation is applied to the finished catalyst comprising metal oxides supported on an alumina support. Treatment of the carrier alone with the silicon compounds does not provide the benefit of the instant invention.

A preferred metals-containing catalyst to be treated by the method described herein comprises nickel, molybdenum and 0–5% wt phosphorous (measured as the element) supported on a porous alumina support preferably comprising gamma alumina. It contains from about 1 to about 5, preferably from about 2 to about 4 percent by weight of nickel (measured as the metal); from about 8 to about 20, preferably from about 12 to about 16 percent by weight of molybdenum (measured as the metal) and, when present, preferably from about 1 to about 5, more preferably from about 2 to about 4 percent by weight of phosphorous (measured as the element), all per total weight of the catalyst. It will have a surface area, as measured by the B.E.T. method (Brunauer et al, J. Am. Chem. Soc., 60, 309–16 (1938)) of greater than about 120 $m^2/g$ and a water pore volume between about 0.2 to about 0.6, preferably between about 0.3 to about 0.5. Cobalt and nickel are know in the art to be substantial equivalents in molybdenum-containing hydrotreating catalysts.

The catalysts of the instant invention are normally presulfided prior to use. Typically, the catalysts are presulfided by heating in $H_2S/H_2$ atmosphere at elevated temperatures. For example, a suitable presulfiding regimen comprises heating the catalysts in a hydrogen sulfide/hydrogen atmosphere (5%v $H_2S$/95%v $H_2$) for about two hours at about 204° C. (400° F.) increasing the temperature to 316° C. (600° F.) and holding for 1 hour and finally increasing the temperature to 371° C. (700° F.) and holding for 2 hours. Other methods are also suitable for presulfiding and generally comprise heating the catalysts to elevated temperatures (e.g., 200°–500° C.) in the presence of hydrogen and a sulfur-containing material.

The instant invention also relates to a process for reducing the nitrogen content of a hydrocarbon feedstock by contacting the feedstock in the presence of added hydrogen with a catalyst prepared as described herein at hydrotreating conditions, i.e., at conditions of temperature and pressure and amounts of added hydrogen such that significant quantities of nitrogen-containing hydrocarbons are reacted with hydrogen to produce gaseous nitrogen compounds which are removed from the feedstock.

The feedstock to be utilized is any crude or petroleum fraction containing in excess of 100 parts per million by weight (ppm) of nitrogen in the form of nitrogen-containing hydrocarbons. Examples of suitable petroleum fractions include catalytically cracked light gas and heavy cracked oils, straight run heavy gas oils, light flash distillates, light cycle oils, vacuum gas oils, coker gas oil, synthetic gas oil and mixtures thereof. The catalysts of the invention are particularly suited for use with the heavy feedstocks that are being processed in a first stage hydrocracker wherein both hydrodenitrification and hydrocracking are occurring. Hydrotreating conditions, including first stage hydrocracking conditions comprise temperatures ranging from about 300° C. to about 450° C. The total pressure will typically range from about 400 to about 2500 psig. The hydrogen partial pressure will typically range from about 200 to about 2200 psig. The hydrogen feed rate will typically range from about 200 to about 10,000 standard cubic feet per barrel ("SCF/BBL"). The feedstock rate will typically have a liquid hourly space velocity ("LHSV") ranging from 0.1 to about 15.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

Catalyst Preparation (18953-159C)

As a base catalyst was used a commercially available hydrotreating catalyst comprising nickel, molybdenum and phosphorous supported on a gamma alumina support. The base catalyst was dried at 400° C. for 1 hour and 201 grams were weighed into a 400 milliliter round bottom flask and 26.5 grams of silicone fluid obtained from Dow Corning (Dow Corning 200 (50cSt)) was used to impregnate the catalyst. After impregnation, the catalyst was then heated from 121° C. (250° F.) to 538° C. (1000° F.) over a period of 30 minutes and then the catalyst was held at 538° C. (1000° F.) for 2 hours. The catalyst was then cooled to room temperature in a desiccator. The catalyst contained about 3% wt of silicon, measured as the metal. This catalyst is denoted Silicon-Promoted Catalyst in the following example.

Hydrodenitrification Process

A silicon-promoted catalyst was tested for its hydrodenitrification activity and hydrocracking activity on an Arabian Heavy Flashed Distillate feedstock. For comparison, the base catalyst (no silicon), and two catalysts using amorphous silica-alumina as a support were also tested. The properties of these catalysts are shown in Table 1 below.

TABLE 1

CATALYST PROPERTIES

| Catalyst | Silicon-Promoted | Base | Ni—Mo Silica—Alumina | Ni—Mo—P Silica—Alumina |
|---|---|---|---|---|
| Metals, % wt | | | | |
| Ni | 2.4 | 3.0 | 3.3 | 3.0 |
| Mo | 13.4 | 13.0 | 13.5 | 13.0 |
| P | 2.6 | 3.2 | — | 3.2 |
| Si | 3.0 | — | 4.5 | 4.9 |
| CBD, g/cc | 0.920 | 0.824 | 0.649 | 0.716 |
| S. Area $m^2/g$ | 155 | 166 | 276 | 236 |

Properties of the feedstock utilized to illustrate the instant invention are detailed in Table 2 below.

TABLE 2

PROPERTIES OF ARABIAN HFD FEEDSTOCK

| | | |
|---|---|---|
| Physical Properties | | |
| Density, 60° F., 70° C. | 0.9346, 0.8968 | |
| Viscosity (Cs), 60° C., 100° C. | 46.5, 11.7 | |
| Molecular Wt. | 442 | |
| Elemental Content | | |
| Hydrogen | 11.9380 wt. % | |
| Carbon | 85.2970 wt. % | |
| Oxygen | 0.1180 wt. % | |
| Nitrogen | 0.1080 wt. % | |
| Sulfur | 2.7300 wt. % | |
| Asphaltenes (wt. %) | | |
| $C_5$ | 0.07 | |
| $C_7$ | 0.07 | |
| Carbon Residue (wt. %) | | |
| Ramsbottom | 0.50 | |
| microcarbon | 1.06 | |
| UV Aromatics Content (wt. %) | MWR | |
| Mono | 4.7 | |
| Di | 3.2 | |
| Tri | 4.3 | |
| Tetra | 4.4 | |
| Total | 16.6 | |
| Boiling Point Distribution | TBP-GLC | |
| IBP | 674° F. | (357° C.) |
| 10 wt. % | 764 | (407) |
| 30 wt. % | 837 | (447) |
| 50 wt. % | 892 | (478) |
| 70 wt. % | 945 | (507) |
| 86 wt. % | 1000 | (538) |

The catalyst testing was performed in pilot scaled microreactors using whole pellets. The catalysts were loaded with the graded bed technique and diluted with 60-80 mesh SiC to minimize feed channeling and to allow for uniform, isothermal operation of the reactor. In this technique, 10 four ounce bottles are loaded with 18.2 grams of 60°80 mesh silicon carbide and 2%, 4%, 8%, 16% or 20% of the catalyst charge of 100 cc is added to each bottle and loaded into the reactor as per the table below. To determine the loading weight, the CBD was multiplied by 100.

| | Catalyst |
|---|---|
| ALIQUOT 1 (top of bed) | 2% wt. |
| ALIQUOT 2 | 2% wt. |
| ALIQUOT 3 | 4% wt. |
| ALIQUOT 4 | 4% wt. |
| ALIQUOT 5 | 8% wt. |
| ALIQUOT 6 | 8% wt. |
| ALIQUOT 7 | 16% wt. |
| ALIQUOT 8 | 16% wt. |
| ALIQUOT 9 | 20% wt. |
| ALIQUOT 10 (bottom of bed) | 20% wt. |

The catalysts were sulfided with 5% hydrogen sulfide in hydrogen at a gas flow rate of 4.0 SCF/hr. Gas flow was established at room temperature and then the reactor temperature was increased to 204° C. for 2 hours, increased to 316° C. and held for 1 hour, and finally increased to 371° C. and held for 2 hours. The following test conditions were used:

WHSV : 1.0 kg feed/1-catalyst-hr

Pressure : 1725 psig (120 bar)

$H_2$ Circulation : 5000 SCF/bbl (1000 Nl/kg feed)

For measuring hydrodenitrification (HDN) activity, the catalysts were broken in at 357° C. for about 200 hours and then the temperature was increased to the temperature at which 7.5 ppm of nitrogen were found in the product. Catalysts with higher hydrodenitrification activities require lower temperatures. These results are shown in Table 3.

For measuring hydrocracking (HC) activity, the catalysts were broken in at 374° C. for about 200 hours and then the temperature was increased to the temperature at which 40% of the feed was converted to material boiling at less than 698° F. (370° C.). Catalysts with higher hydrocracking activities require lower temperatures. These results are shown in Table 3.

TABLE 3

HDN AND HC RESULTS

| Catalyst | Silicon-Promoted | Base | Ni—Mo Silica—Alumina | Ni—Mo—P Silica—Alumina |
|---|---|---|---|---|
| Temp. required for 7.5 ppm N in product | 721° F. (383° C.) | 733° F. (389° C. | 757° F. (403° C.) | 745° F. (396° C.) |
| Temp. required for 40% conversion of feed to 370° C.⁻ material | 752° F. (400° C.) | 778° F.* (414° F.) | 765° F. (407° C.) | 758° F. (403° C.) |

*Carried out at a WHSV of 0.8 and the results were calculated for a WHSV of 1.0.

What is claimed is:

1. In a hydrofining process which hydrogenates nitrogen-containing hydrocarbons in a hydrocarbon feedstock which comprises contacting at hydrofining conditions said feed stock and hydrogen with a catalyst comprising a hydrogenating metal component selected from nickel, molybdenum and mixtures thereof supported on an alumina support, the improvement which comprises using as catalyst said hydrogenating metal component supported on alumina which has been modified by impregnating said hydrogenating metal component supported on alumina with a liquid form of a silicon compound having the general formula

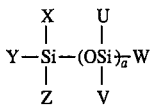

wherein U, V, W, X, Y, and Z can individually be —R or —$SiH_3$, R being either hydrogen, or an alkyl, cycloalkyl, aromatic, alkyl aromatic, alkylcycloalkyl radical having from 1 to 30 carbon atoms, and "a" being a whole number in the range of from 5 to 60, in an amount sufficient to deposit from about 2 percent to about 8 percent by weight of the total catalyst of Si, and subsequently calcining said impregnated catalyst at a temperature ranging from about 300° C. to about 600° C. in an oxidizing atmosphere.

2. The process of claim 1 wherein U, V, W, X, Y and Z are individually hydrogen, methyl or ethyl.

3. The process of claim i wherein the silicon compound is in the form of a liquid having a viscosity of less than about 100 cSt (measured at 40° C.).

4. The process of claim 1 wherein the silicon compound is in the form of a liquid having a viscosity of less than 75 cSt (measured at 40° C.).

5. The process of claim 4 wherein the amount of Si deposited on the catalyst ranges from about 3 to about 6 percent by weight of the catalyst.

6. The process of claim 5 wherein the catalyst additionally comprises phosphorus as a promoter.

7. The process of claim 1 wherein the hydrofining process is a first stage hydrocracking process.

8. In a hydrotreating catalyst comprising a hydrogenating metal component selected from nickel, molybdenum and mixtures thereof supported on an alumina support, the improvement which comprises impregnating said hydrogenating metal component supported on alumina with a liquid form of a silicon compound having the general formula

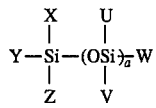

wherein U, V, W, X, Y, and Z can individually be —R or —$SiH_3$, R being either hydrogen, or an alkyl, cycloalkyl, aromatic, alkyl aromatic, alkylcycloalkyl radical having from 1 to 30 carbon atoms, and "a" being a whole number in the range of from 5 to 60, in an amount sufficient to deposit from about 2 percent to about 8 percent by weight of the total catalyst of Si, and subsequently calcining said impregnated catalyst at a temperature ranging from about 300° C. to about 600° C. in an oxidizing atmosphere.

9. The catalyst of claim 8 wherein U, V, W, X, Y and Z are individually hydrogen, methyl or ethyl.

10. The catalyst of claim 8 wherein the silicon compound is in the form of a liquid having a viscosity of less than 100 cSt (measured at 40° C.).

11. The catalyst of claim 8 wherein the silicon compound is in the form of a liquid having a viscosity of less than 75 cSt (measured at 40° C.).

12. The catalyst of claim 11 wherein the amount of Si deposited on the catalyst ranges from about 3 to about 6 percent by weight of the catalyst.

13. The catalyst of claim 12 wherein the catalyst additionally comprises phosphorus as a promoter.

14. A process for improving the hydrodenitrification activity of a hydrotreating catalyst which comprises a hydrogenating metal component selected from the group consisting of nickel, molybdenum and mixtures thereof supported on an alumina support, said process comprising impregnating said hydrogenating metal component supported on alumina with a liquid form of a silicon compound having the general formula

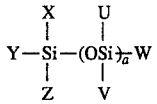

wherein U, V, W, X, Y, and Z can individually be —R or —$SiH_3$, R being either hydrogen, or an alkyl, cycloalkyl, aromatic, alkyl aromatic, alkylcycloalkyl radical having from 1 to 30 carbon atoms, and "a" being a whole number in the range of from 5 to 60, in an amount sufficient to deposit from about 2 percent to about 8 percent by weight of the total catalyst of Si, and subsequently calcining said impregnated catalyst at a temperature ranging from about 300° C. to about 600° C. in an oxidizing atmosphere.

15. The process of claim 14 wherein U, V, W, X, Y and Z are individually hydrogen, methyl or ethyl, 16. The process of claim 14 wherein the silicon compound is in the form of a liquid having a viscosity of less than 100 cSt (measured at 40° C.).

17. The process of claim 14 wherein the silicon compound is in the form of a liquid having a viscosity of less than 75 cSt (measured at 40° C.).

18. The process of claim 17 wherein the amount of Si deposited on the catalyst ranges from about 3 to about 6 percent by weight of the catalyst.

19. The process of claim 18 wherein the catalyst additionally comprises phosphorus as a promoter.

20. In a hydrofining process which hydrogenates nitrogen-containing hydrocarbons in a hydrocarbon feedstock which comprises contacting at hydrofining conditions said feed stock and hydrogen with a catalyst comprising a hydrogenating metal component selected from nickel, molybdenum and mixtures thereof supported on an alumina support, the improvement which comprises using as catalyst said hydrogenating metal component supported on alumina which has been modified by impregnating said hydrogenating metal component supported on alumina with a liquid form of a silicon compound having the general formula

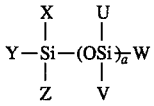

wherein U, V, W, X, Y, and Z is —R or —OR, R being either hydrogen, or an alkyl, cycloalkyl, or alkylcycloalkyl radical having from 1 to 30 carbon atoms and "a" being a whole number in the range of from 5 to 60, in an amount sufficient to deposit from about 3 to about 6 percent by weight of the total catalyst of Si, and subsequently calcining said impregnated catalyst at a temperature ranging from about 300° C. to about 600° C. in an oxidizing atmosphere.

21. In a hydrotreating catalyst comprising a hydrogenating metal component selected from nickel, molybdenum and mixtures thereof supported on an alumina support, the improvement which comprises impregnating said hydrogenating metal component supported on alumina with a liquid form of a silicon compound having the general formula

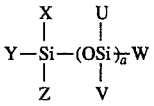

wherein U, V, W, X, Y, and Z is —R, R being either hydrogen, or an alkyl, cycloalkyl, alkylcycloalkyl radical having from 1 to 30 carbon atoms, and "a" being a whole numbers in the range of from 5 to 60, in an amount sufficient to deposit from about 3 to about 6 percent by weight of the total catalyst of Si, and subsequently calcining said impregnated catalyst at a temperature ranging from about 300° C. to about 600° C. in an oxidizing atmosphere.

22. A method for improving the hydrodenitrification activity of a hydrotreating catalyst which comprises a hydrogenating metal component selected from the group consisting of nickel, molybdenum and mixtures thereof supported on an alumina support, said method comprising impregnating said hydrogenating metal component supported on alumina with a liquid form of a silicon compound having the general formula

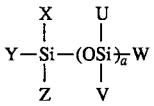

wherein U, V, W, X, Y, and Z is —R, R being either hydrogen, or an alkyl, cycloalkyl, alkylcycloalkyl radical having from 1 to 30 carbon atoms, and "a" being a whole number in the range of from 5 to 60, in an amount sufficient to deposit from about 3 to about 6 percent by weight of the total catalyst of Si, and subsequently calcining said impregnated catalyst at a temperature ranging from about 300° C. to about 600° C. in an oxidizing atmosphere.

* * * * *